US006906468B2

(12) United States Patent
Riepe et al.

(10) Patent No.: US 6,906,468 B2
(45) Date of Patent: Jun. 14, 2005

(54) BALLAST DEVICE FOR UV RADIATOR AND ALSO METHOD AND DEVICE FOR DISINFECTING WATER

(75) Inventors: Dirk Riepe, Herford (DE); Jan Boris Rudkowski, Bielefeld (DE); Joachim Fischer, Hessisch Oldendorf (DE)

(73) Assignee: Wedeco AG Water Technology (DE)

( * ) Notice: Subject to any disclaimer, the term of this patent is extended or adjusted under 35 U.S.C. 154(b) by 181 days.

(21) Appl. No.: 10/296,479

(22) PCT Filed: Mar. 21, 2002

(86) PCT No.: PCT/EP02/03203

§ 371 (c)(1),
(2), (4) Date: Nov. 21, 2002

(87) PCT Pub. No.: WO02/076153

PCT Pub. Date: Sep. 26, 2002

(65) Prior Publication Data

US 2003/0132717 A1 Jul. 17, 2003

(30) Foreign Application Priority Data

Mar. 21, 2001 (DE) ..... 101 13 903

(51) Int. Cl.[7] ..... H05B 37/00
(52) U.S. Cl. ..... 315/104; 315/105; 315/106
(58) Field of Search ..... 315/103, 104, 315/105, 106, 107

(56) References Cited

U.S. PATENT DOCUMENTS 4,972,126 A 11/1990 Nilssen
5,047,696 A 9/1991 Nilssen

FOREIGN PATENT DOCUMENTS

| | | |
|---|---|---|
| DE | 21 51 854 | 4/1973 |
| DE | 4303595 | 8/1994 |
| DE | 19637906 | 3/1997 |
| DE | 196 19 022 | 11/1997 |
| EP | 0750447 | 12/1996 |
| EP | 0845928 | 6/1998 |
| EP | 0871349 | 10/1998 |
| JP | 35410327 A * | 8/1979 |
| WO | WO 98/24277 | 6/1998 |

OTHER PUBLICATIONS

JP 01–084598, Patent Abstracts of Japan, Mar. 29, 1989.
JP 10–149887, Patent Abstracts of Japan, Jun. 2, 1998.
JP 06–111964, Patent Abstracts of Japan, Apr. 22, 1994.

* cited by examiner

*Primary Examiner*—David Vu
(74) *Attorney, Agent, or Firm*—Robert W Becker & Associates; Robert W Becker

(57) ABSTRACT

The invention relates to a novel ballast device for preheating, starting and operating at least one UV emitter, constructed in the form of a gas discharge lamp with two heating coils lying opposite each other in relation to a gas discharge path, whereby four electrical connections are provided in total for each of such gas discharge paths, namely two for each heating coil. According to the invention, switching means are provided for a parallel switching of both of said connectors of a heating coil, dependent upon operating conditions. A capacitive loading of the ballast device is thus avoided by means of the otherwise open connector line for the heating coil and the current feed to the coils is evenly distributed.

19 Claims, 1 Drawing Sheet

BALLAST DEVICE FOR UV RADIATOR AND ALSO METHOD AND DEVICE FOR DISINFECTING WATER

BACKGROUND OF THE INVENTION

1. Field of the Invention

The present invention relates to a ballast unit and also to a method and a device for disinfecting water.

2. Description of Related Art

A generic ballast unit is disclosed in DE 196 37 906 A1. In this so-called electronic ballast unit, the connected radiator is operated during operation at a frequency of about 20 kHz to 50 kHz, whereas the conventional ballast units operate at the mains frequency of 50 Hz. As also in the case of conventional ballast units, two connecting leads are routed to each heating coil of the connected gas-discharge lamp. Via said leads, a heating voltage is first applied to the heating coils and brings about heating of the coil. As soon as the temperature is high enough to make it possible for electrons to escape from the surface, the gas discharge is ignited by a high-voltage pulse. The heating voltage is switched off and the operating voltage of the gas-discharge lamp is applied to a connecting lead of each heating coil. The switching between heating voltage and operating voltage takes place in the generic ballast unit with semiconductors. During operation, voltage is applied to only one conductor per coil so that the respective other conductor is unconnected. The power of the connected UV radiator is automatically controlled by a pulse-width modulation.

Because one coil conductor is used in each case only for heating and is an open-circuit conductor during operation, the reactive effect on the heating circuit due to reflections in the cable is very great. If a cable length of 8 m between the lamp and the ballast unit is exceeded, the oscillatory behavior at the heating circuit in combination with the high frequency of the operating voltage of about 20 kHz to 50 kHz is so severe that it may result in the destruction of the circuit. Furthermore, the oscillatory processes are transformed onto the primary side of the push-pull output stage used in the known ballast unit. During the switching of the semiconductor switches, high-frequency oscillatory processes occur at the instant of switching that result in a severe loading of the semiconductor switches.

For this reason, the distances between a control unit containing the ballast units and the UV radiator arrangement operated therewith in a wastewater or drinking-water disinfecting system have hitherto not been able to exceed about eight meters, which is regarded as constructionally disadvantageous, in particular in the case of extensive systems.

WO 98/24277 discloses a quick-start circuit for fluorescent lamps that can be combined both with conventional chokes and with the electronic ballast units common in this technical field. Both techniques require a series oscillatory circuit having a choke in the lamp supply line, which at the same time brings about the current limitation. In such circuits, the supply current applied to the lamps is essentially sinusoidal. These ballast units and quick starters are always disposed in the immediate vicinity of the luminaires. Problems with the conductor length between the ballast unit and the luminaire are irrelevant in this case.

To reduce the stress on the electrodes, they are short-circuited in the case of the known quick-start device immediately prior to ignition and during operation and the feed conductors are connected in parallel. This parallel connection takes place between the quick-start device and the electrodes. The two lamp feed conductors emerging from the ballast unit are themselves not connected in parallel between the ballast unit and the quick-start device. This circuit does not solve the problem of large conductor lengths in electronic ballast units according to DE 19637906 that operate with high-frequency supply voltages having great edge steepness. The ballast units do not have a choke in the feed conductor and can therefore generate, for example, a rectangular current variation.

SUMMARY OF THE INVENTION

The object of the present invention is therefore to provide a ballast unit and also a device and a method for operating a wastewater or drinking-water disinfecting system that, despite a high-frequency operating voltage, permits a greater distance between ballast unit and radiator.

This object is achieved by a ballast unit and also by a device and a method for operating a wastewater or drinking-water disinfecting system, as defined in the appended claims.

Because switching means are provided for an operating-state-dependent parallel connection of the two connections in each case of a heating coil, the disadvantageous effects of an open-circuit connecting lead due to the HF operating voltage are eliminated in the operation of the radiator. Furthermore, a lengthening of the service life of the radiator can be expected since the escape of the electrons from the respective coil is distributed over its surface and the selective electron emission at the so-called hotspot does not therefore occur.

If furthermore at least one relay is provided as switching means, the connecting leads may be at almost any desired potential. In addition, the relays are not critical in regard to their transient response.

The use of relays that are closed in the quiescent state (normally-closed—NC) in such a way that the at least one relay brings about a parallel connection in the quiescent state leaves the relay and the firing system load-free during operation.

The component expenditure is minimized if a quadruple center-zero relay is provided for every two radiators.

Because, in the case of the device according to the invention for disinfecting drinking water or treated wastewater by means of UV radiation, wherein the UV radiation is generated by at least one radiator of the construction of a gas-discharge lamp having two heating coils that are situated mutually opposite with respect to a gas-discharge path and wherein a total of four electrical connections leading from a ballast unit to the radiator are provided for every such radiator, namely two each for every heating coil of the radiator, a heating voltage is applied to the two connecting leads leading to every heating coil in each case prior to the ignition of the radiator and the two connecting leads leading to every heating coil in each case are electrically connected in parallel after the ignition and during operation, the distance between the respective ballast unit and the UV radiators can be almost as large as desired. In particular, the connecting leads between the ballast unit and the radiator can have a length of at least eight meters, in particular more than 15 meters.

The loading of the ballast unit in the device is reduced if a capacitor is connected in parallel to every heating coil.

Because, in the case of the method according to the invention for operating a disinfecting device for drinking water or treated wastewater by means of UV radiation, wherein the UV radiation is generated by at least one radiator of the construction of a gas-discharge lamp having two heating coils situated mutually opposite with respect to a gas-discharge path, wherein a total of at least four electrical connecting leads between a ballast unit and the radiator are provided for every such radiator, namely two each for every heating coil of the radiator, and wherein the operating voltage for the UV radiator has a frequency of 10 kHz to 100 kHz, in particular between 20 kHz and 50 kHz, the following steps are provided:

application of a heating voltage to the two connecting leads leading to every heating coil in each case prior to the ignition of the radiator;

ignition of the radiator by applying an ignition voltage to the heating coil;

parallel connection of the two connecting leads leading to a heating coil in each case after the ignition and during operation, the advantages already mentioned are achieved in regard to conductor length and service life of the radiators.

The dimensions of the relays used can be made relatively small if they are always switched in a load-free manner, in particular the heating voltage, the ignition voltage and the operating voltage are not applied to the connecting leads during a switching operation of the relay.

The same applies if, prior to the parallel connection of the connecting leads, the electrical heating power fed to the heating coils is gradually increased and the normally high switch-on current for cold heating coils is thus limited. The power is preferably increased by means of pulse-width modulation or power limitation.

Finally, even after the parallel connection of the connecting leads, the electrical power fed to the radiators for their operation can first be reduced with respect to normal operation and then increased, with the result that the operating parameters of the system are achieved gradually and without load peaks for the individual components.

BRIEF DESCRIPTION OF THE FIGURES

An exemplary embodiment of the present invention is described below by reference to the drawing. In the latter

DETAILED DESCRIPTION

Figure 1:
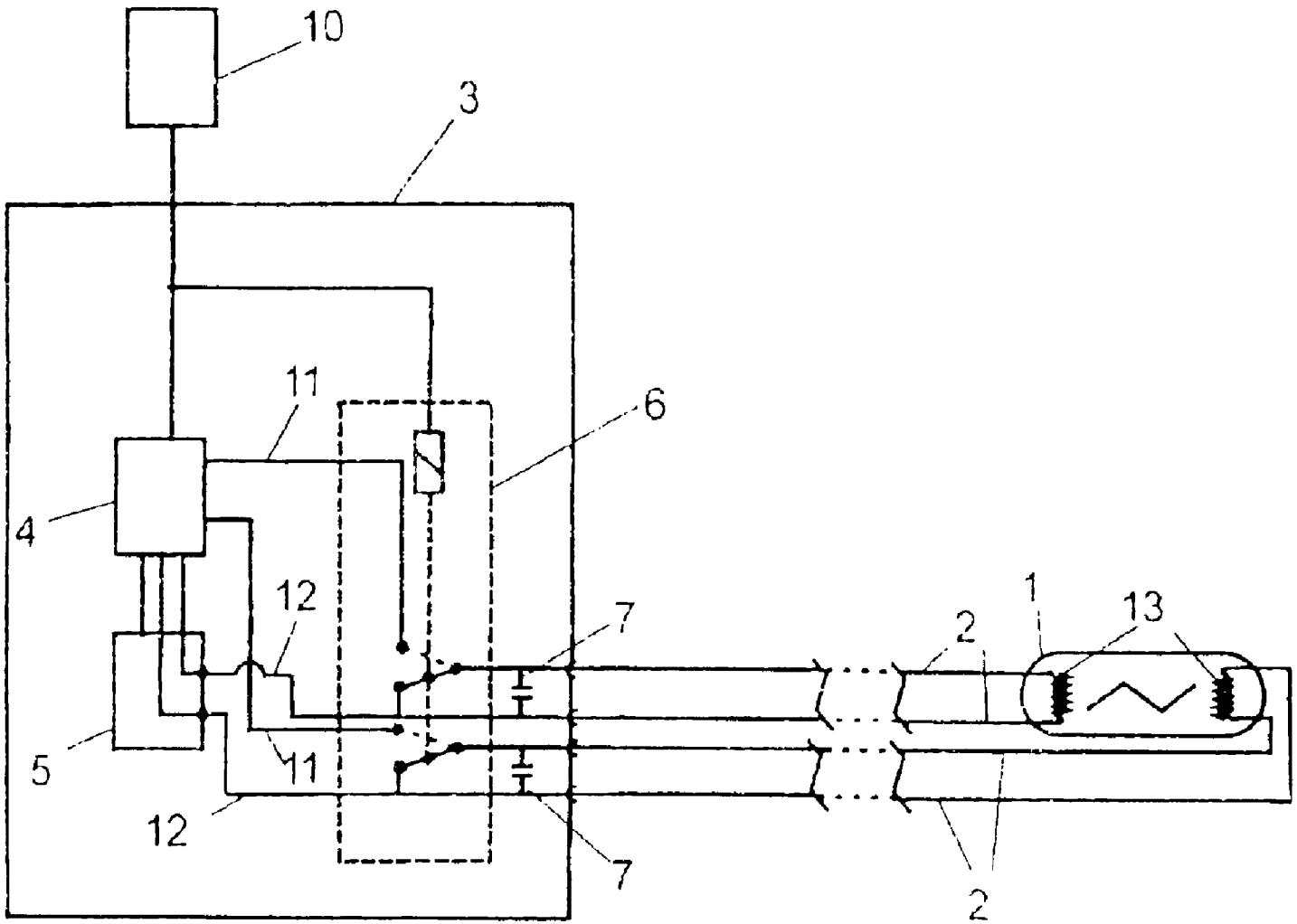
FIG. 1 shows a diagrammatic wiring of a UV radiator in the novel device comprising the novel ballast unit.

FIG. 1 shows a simplified circuit diagram for illustrating the present invention.

A UV radiator or emitter 1 is connected via a four-core connecting lead 2 to a ballast unit 3. The ballast unit 3 contains a heating-voltage source 4, an operating-voltage and ignition-voltage source 5, a double switching relay 6 shown in its quiescent position (NC) and two capacitors 7.

During operation, a control 10 controls the parameters of the voltages and currents delivered by the voltage supplies 4 and 5, and also the relay 6. The voltages and currents delivered are conducted via conductors 11 of the heating-voltage source 4 and also conductors 12 of the operating-voltage and ignition-voltage source 5 to the relay 6 and, depending on the switching state of the relay 6, from there to two coils 13.

To start the UV radiator, current is first applied to the relay 6, with the result that it operates and connects the coil 13 to the heating-voltage source 4 via the conductors 11. After the switching operation has taken place, the output current of the heating-voltage source 4 is slowly increased to the rated value by the control 10 and the coil 13 is heated. The operating-voltage and ignition-voltage source 5 is then likewise induced by the control 10 to provide an ignition pulse via the conductors 12 to the coil 13, with the result that the gas discharge is ignited. At the same time, the operating voltage, which is first kept at a low power after the fashion of a dimmer, is already applied via the conductors 12.

If, finally, it can be verified by means of evaluation of the parameters of the operating-voltage source that the gas discharge has been successfully started, the relay 6 drops out and connects the conductors 2 leading to each coil 13 in parallel. At the same time, the capacitors 7 smooth any voltage peaks that occur. The high-frequency operating voltage is then fed to both sides of the coil 13. That branch of the conductors initially connected to the heating-voltage supply 4 is then not open-circuit. Finally, after parallel connection has taken place, the power of the radiator 1 is increased to the rated value. The starting-up of the radiator 1 is consequently finished.

Corresponding remarks apply if a plurality of radiators 1 is fed by a ballast unit 3. In particular, to supply two radiators with one ballast unit, the relay 6 can be designed as a quadruple center-zero relay so that the circuit remains simple.

In principle, the parallel connection of the conductors 2 leading to a coil 13 in each case can take place using any desired switching means. The novel ballast unit has, however, preferably relays for the parallel connection of the connecting leads during operation, which has a plurality of advantages over the current circuit. The novel switching logic now couples the coils to the heating circuit by means of relays and, during operation, the two radiator supply conductors are short-circuited at the ballast unit on each side of the coil. This results in operation at two parallel connecting leads and the power is distributed symmetrically over them. As a result, there is no longer any open-circuit line and the reactive effects of the high-frequency operating voltage on the individual circuit parts are minimized. In practice, cable lengths of over 50 m are possible.

The heating method is notable for the fact that the heating current can increase only slowly as a result of the slow increase in pulse width by means of digital control of the primary side of the main transformer. When the coils are cold, the internal resistance is lowest. Since the source resistance of the heating circuit is very low, a very high initial current would flow without this control.

The logic is very suitable for relay operation since the digital control logic makes possible the independent switching-on of the relay. That is to say, the relay is switched shortly before the output stage switches on the heating current. The operation time of the relay is taken into account. Consequently, current flow at the contacts at the instant of switching is avoided, which contributes markedly to the relay service life. If the radiators have ignited, the power is limited insofar as, despite the very low-impedance state of the radiator, the radiator current is kept below the rated current. When the relay opens, the radiator current is distributed over both sides of the coil and loads the relay only to a small extent. A capacitor across the heating coils ensures a gentle transition.

The digital control of the entire ballast unit combines ignition, preheating and normal operation. All the parameters, such as preheating time, preheating current and ignition are matched to the radiator in the control software.

The heating logic is optimized to the special application involving high-power UV amalgam radiators in which the operating voltage for the UV radiators has a frequency of 10 kHz to 100 kHz, in particular between 20 kHz and 50 kHz. These mercury low-pressure radiators have very low-impedance coils and are consequently not comparable with coils such as those known from lighting technology. The heating current is approximately 3 A.

Conventionally, when the current enters the plasma column, a hotspot forms that selectively results in a very high coil loading. This results in detachment of material from the coil which contributes to the blackening of the radiator and consequently to aging. The novel radiator operation minimizes these above-described effects. The entry of the electrons into the plasma column distributes itself over the coil.

Instead of a four-core connecting lead, connecting leads having more than four cores can also be used, in particular also those having eight cores. According to the technical features set out above, four conductors are then connected in parallel for every coil during operation. The characteristic impedance of the connecting leads is thereby matched better to the requirements existing in the case of long connecting leads.

The specification incorporates by reference the disclosure of German priority document 101 13 903.9 filed 21 Mar. 2001 and International priority document PGT/EP02/03203 filed 21 Mar. 2002.

The present invention is, of course, in no way restricted to the specific disclosure of the specification and drawings, but also encompasses any modifications within the scope of the appended claims.

What is claimed is:

1. A ballast unit for preheating, igniting and operating at least one UV radiator of the construction of a gas-discharge lamp having two heating coils situated mutually opposite with respect to a gas-discharge path, wherein a total of at least four electrical connections are provided for each such radiator, namely two each for every heating coil, and wherein the operating voltage for the UV radiators has a frequency of 10 kHz to 100 kHz, wherein at least four electrical connecting leads are provided between the ballast unit and the radiator, namely two each for every heating coil, and wherein switching means are provided for an operating-state-dependent parallel connection of the two connecting leads of a heating coil in each case.

2. A ballast unit according to claim 1, wherein at least one relay is provided as said switching means.

3. A ballast unit according to claim 2, wherein said at least one relay brings about the parallel connection in a quiescent state.

4. A ballast unit according to claim 1, wherein a quadruple center-zero relay is provided for every two radiators.

5. A device for disinfecting drinking water or treated wastewater by means of UV radiation, wherein the UV radiation is generated by at least one radiator of the construction of a gas-discharge lamp having two heating coils situated mutually opposite with respect to a gas-discharge path, wherein a total of at least four electrical connections leading from a ballast unit to the radiator are provided for every such radiator, namely two each for every heating coil of the radiator, wherein the connecting leads between the ballast unit and the radiator have a length of at least eight meters and wherein the operating voltage for the UV radiators has a frequency of 10 kHz to 100 kHz, wherein means are provided for applying a heating voltage to the at least two connecting leads leading to every heating coil in each case prior to ignition of the radiator, and the at least two connecting leads leading to every heating coil are electrically connected in parallel after the ignition and during operation.

6. A device according to claim 5, wherein the connecting leads between the ballast unit and the radiator have a length of more than 15 meters.

7. A device according to claim 5, wherein a capacitor is connected in parallel with every heating coil.

8. A method for operating a disinfecting device for drinking water or treated wastewater by means of UV radiation, wherein the UV radiation is generated by at least one radiator of the construction of a gas-discharge lamp having two heating coils situated mutually opposite with respect to a gas-discharge path, wherein a total of at least four electrical connecting leads between a ballast unit and the radiator are provided for every such radiator, namely two each for every heating coil of the radiator, and wherein the operating voltage for the UV radiator has a frequency of 10 kHz to 100 kHz, said method including the following steps:

applying a heating voltage to the at least two connecting leads leading to every heating coil in each case prior to ignition of the radiator;

igniting the radiator by applying an ignition voltage to the heating coils;

connecting in parallel the at least two connecting leads leading to a heating coil in each case after the ignition and during operation.

9. A method according to claim 8, wherein the at least one relay is always switched in a load-free manner, in particular the heating voltage, the ignition voltage and the operating voltage are not applied to the connecting leads during a switching operation of the relay.

10. A method according to claim 8, wherein, prior to the parallel connection of the connecting leads, the electrical heating power fed to the heating coils is gradually increased.

11. A method according to claim 10, wherein the power is increased by means of pulse-width modulation or power limitation.

12. A method according to claim 8, wherein after the parallel connection of the connecting leads, the electrical power fed to the radiators for their operation is first reduced with respect to normal operation and then increased.

13. A ballast unit according to claim 1, wherein the operating voltage for the UV radiators has a frequency of between 20 kHz and 50 kHz.

14. A ballast unit according to claim 1, wherein the connecting leads between the ballast unit and the radiator have a length of at least eight meters.

15. A ballast unit according to claim 14, wherein the connecting leads between the ballast unit and the radiator have a length of more than 15 meters.

16. A device according to claim 5, wherein the operating voltage for the UV radiators has a frequency of between 20 kHz and 50 kHz.

17. A method according to claim 8, wherein the operating voltage for the UV radiators has a frequency of between 20 kHz and 50 kHz.

18. A method according to claim 8, wherein the connecting leads between the ballast unit and the radiator have a length of at least eight meters.

19. A method according to claim 18, wherenin the connecting leads between the ballast unit and the radiator have a length of more than 15 meters.

* * * * *